United States Patent [19]

Echeverri

[11] Patent Number: 4,608,811

[45] Date of Patent: Sep. 2, 1986

[54] TOY SADDLE ADAPTED TO BE CARRIED BY AN ADULT PERSON

[76] Inventor: Frank J. Echeverri, 6422 Gentry Ave., North Hollywood, Calif. 91606

[21] Appl. No.: 675,412

[22] Filed: Nov. 27, 1984

[51] Int. Cl.[4] ..... B68C 1/02

[52] U.S. Cl. ..... 54/44

[58] Field of Search ..... 54/44, 46, 37

[56] References Cited

U.S. PATENT DOCUMENTS

| | | | |
|---|---|---|---|
| 1,214,364 | 1/1917 | Peterson | 54/46 |
| 2,252,971 | 8/1941 | Goldstein | 54/37 X |
| 2,534,904 | 12/1950 | Feero | 54/44 X |
| 3,312,040 | 4/1967 | Nuzzo | 54/44 |
| 3,872,653 | 3/1975 | Thompson | 54/44 |
| 3,916,604 | 11/1975 | Phipps | 54/44 |

*Primary Examiner*—Robert P. Swiatek

*Attorney, Agent, or Firm*—Evanns & Walsh

[57] ABSTRACT

A miniaturized toy saddle constructed and configured to be adapted for mounting on the back of an adult person positioned on his hands and knees. The saddle is constructed to make it possible for a child to ride in the saddle when it is mounted on the adult's back. The saddle has a unique contour and configuration on its underside, including padding. The contour and configuration provide a substantially flat part to rest on the person's back with padding between the underside of the saddle and the person's back and additional padding of greater lateral extent extending downwardly and on the inside of lower portions of the saddle and contoured to comfortably be engaged by side parts of the adult person's back.

4 Claims, 5 Drawing Figures

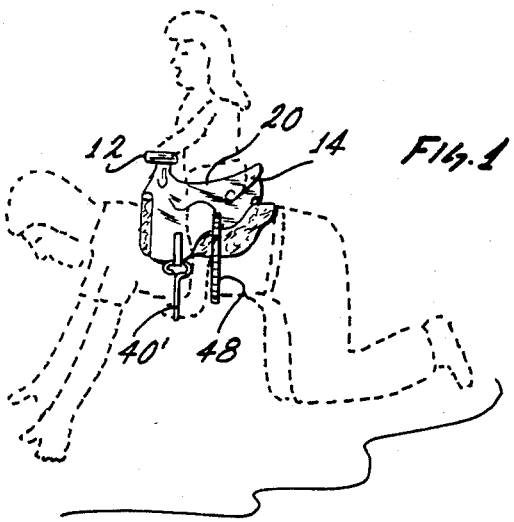
Fig. 1
Fig. 2
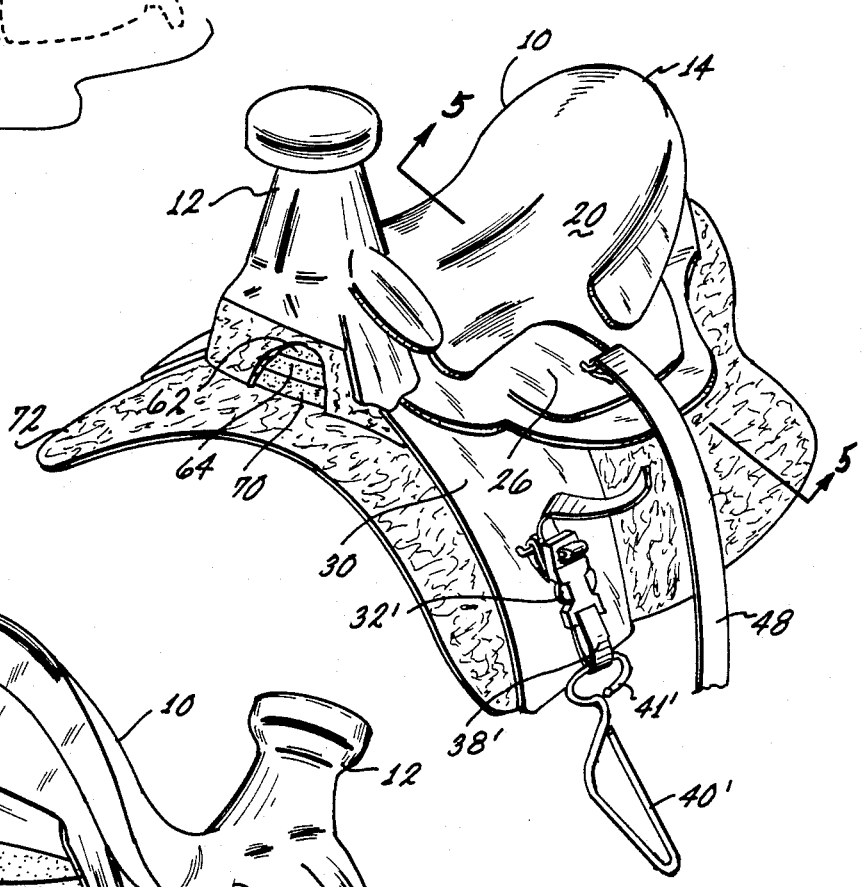
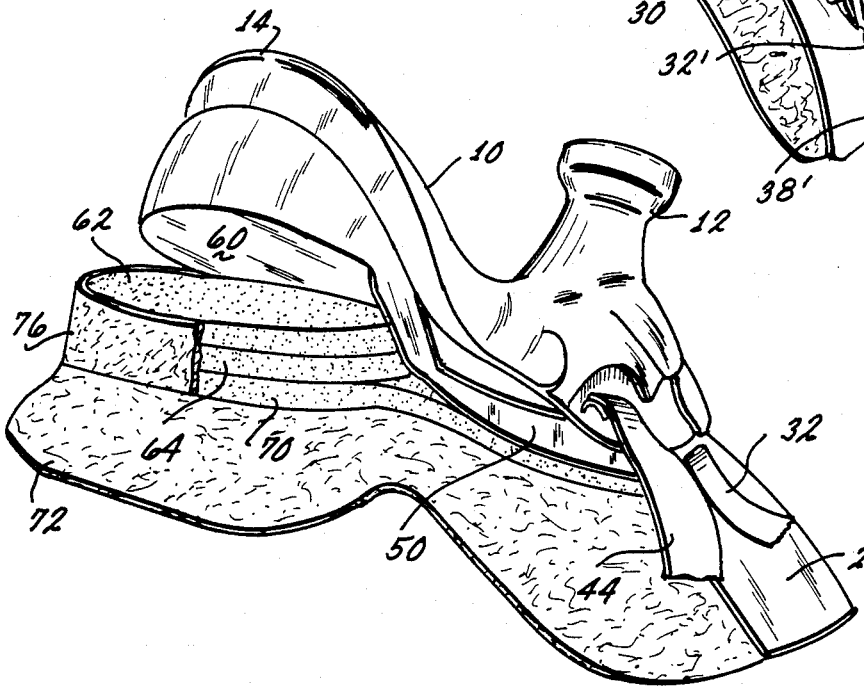
Fig. 3

TOY SADDLE ADAPTED TO BE CARRIED BY AN ADULT PERSON

BACKGROUND OF THE INVENTION

1. Field of the Invention

The field of the invention is that of toys and, more particularly, a small or miniaturized saddle adapted to be strapped to the back of an adult person and to carry a child to simulate the child riding a horse.

2. Description of the Prior Art

It has been known in the prior art, that is, the idea or concept of an adult person, such as the father of a child, positioning himself on his hands and knees and then having a young child ride on his back. This exercise, of course, is very entertaining from the standpoint of a minor child and provides satisfaction for the adult person, such as the father, as well. This exercise as described can, of course, be greatly facilitated and made much closer to simulation of actual horseback riding by providing what is in effect a saddle to be strapped to the back of the adult person. To the knowledge of the herein inventor, such an article as this has never before existed, and accordingly, the possibilities of such an article have not been exploited nor have the benefits or advantages thereof been available. It is the purpose of the herein invention to provide this new and unique article and to make possible the enjoyment of all of the advantages and benefits that flow from it.

SUMMARY OF THE INVENTION

A preferred form of the invention is described in detail hereinafter. The saddle of the invention has an outward appearance resembling a typical, full-size saddle as used for riding horses. However, the construction is uniquely different in order to provide the item with needed capabilities to adapt it for positioning and usage on the back of an adult person positioned on his hands and knees. In the preferred form of construction, the frame of the saddle, that is, what would be similar to the saddle tree, that is, the wooden frame of a known type of saddle, is preferably constructed of plastic and preferably is molded. The molded portion of the saddle has a front or forward part generally constituting an arch and in that sense simulating the pommel of a conventional saddle, and this part of the saddle is preferably provided with a saddle horn. At the back or rear part of the saddle is an upstanding part forming a back.

The construction of the portion of the saddle that is mounted on the back of the adult person is of distinctly unique construction. Underneath that frame or body of the saddle there is provided an essentially flat surface contoured to conform to the back of the adult person in a posture on his hands and knees. The construction is unlike that of a known type of saddle for a horse wherein the underpart of the saddle is contoured to conform to the back of the horse, that is, the back of a horse is convexly contoured and the interior of the saddle is concavely contoured to conform to the horse's back. With respect to the saddle of the invention, the underside of the frame or body of the saddle as stated is essentially of a flat contour to conform to the back of the individual with portions at the sides of the flat portion contoured to engage or fit the sides of back of the adult individual on whom the saddle is to be mounted. One or more layers of padding is provided underneath this part of the saddle, and this may preferably or conveniently be provided by foam rubber so that the saddle can be carried with comfort.

At the sides of the saddle are depending flexible parts which depend from the frame or body. Also depending at the sides of the saddle or stirrups, including stirrup leathers or straps having at their ends fixtures shaped to receive the foot of the minor child riding in the saddle.

In light of the foregoing, the primary object of the invention is to make available a distinctly unique new toy in the form of a saddle particularly constructed to have the capability of being mounted and carried on the back of an adult person in a position on his hands and knees, the saddle being constructed to have a child mounted and to ride thereon.

A further object is to provide a new article as in the foregoing wherein the underside of the saddle is particularly contoured and padded to have the capability of adapting to, or fitting to, the back of an adult person positioned on his hands and knees, the padding being contoured to provide appropriate cushioning between the underside of the saddle and the back of the adult person.

A further object is to realize a unique toy as in the foregoing having external construction and appearance to simulate a type of saddle as ordinarily used for riding on a horse.

Further objects and additional advantages of the invention will become apparent from the following detailed description and annexed drawings.

BRIEF DESCRIPTION OF THE DRAWINGS

FIG. 1 is a pictorial view illustrating the positioning of the saddle of the invention on the back of an adult person on his hands and knees;

FIG. 2 is an illustrative isometric view of the saddle from a forward position;

FIG. 3 is a partly cut away isometric view of the saddle from a rear position;

DESCRIPTION OF PREFERRED EMBODIMENT AND MODE OF PRACTICE

Figure 4:
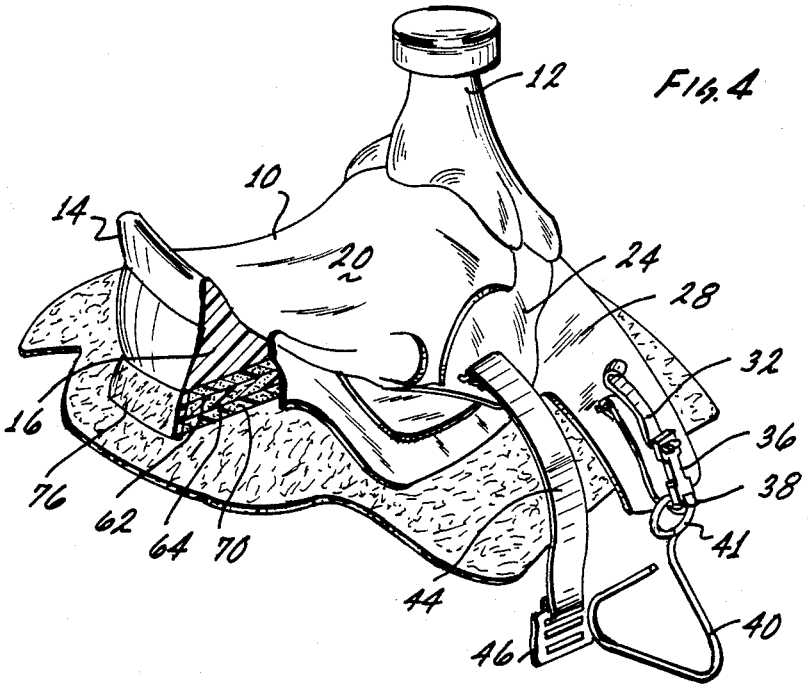
FIG. 4 is a view similar to that of FIG. 3 from a different rearward position with a part of the rear part of the saddle shown cut away.
Figure 5:
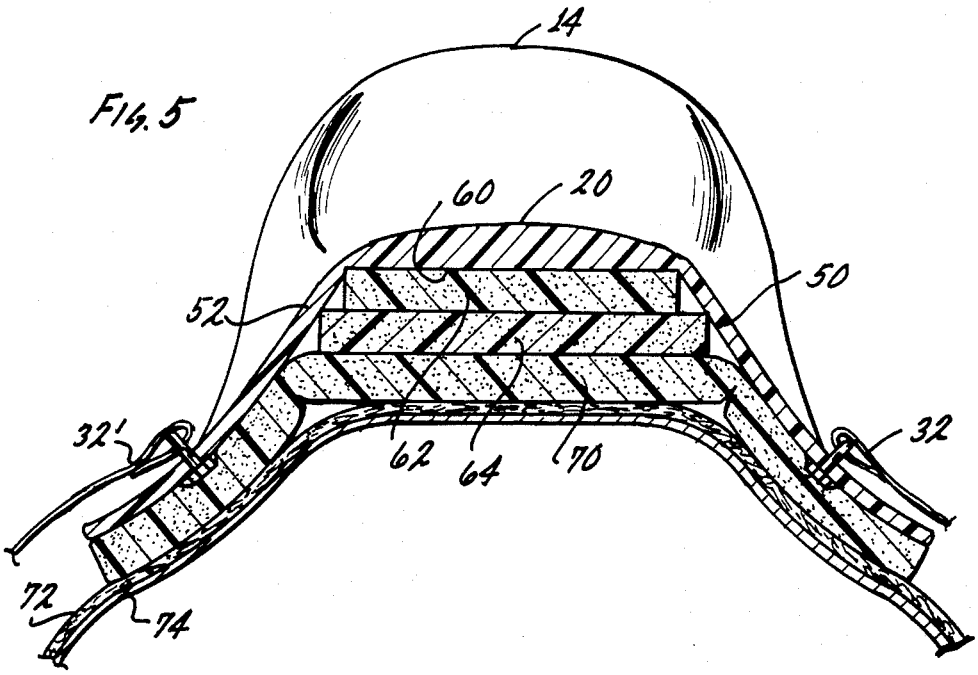
FIG. 5 is a cross-sectional view taken along line 5—5 of FIG. 2.

Referring to the figures of the drawing, the frame or body part of the saddle is preferably of molded construction being molded from plastic, the body part of the saddle being identified by the numeral 10. At the forward part of the saddle is an integral part formed as a saddle horn as designated at 12. At the rear or back part of the saddle is an upstanding back part as designated at 14 in the figures. The configuration and contour can be readily ascertained by an inspection of the figures. The cross section of this part can be seen as indicated at 16 in FIG. 4.

The portion of the saddle in between the horn 12 and the back part 14 is of contoured construction, being convex and configured to be adapted to have a child comfortably seated thereon. This portion of the saddle is identified by the numeral 20.

At the sides of the saddle are depending portions which extend downwardly from the body of the saddle, these portions being of plastic material and being flexible, the portions being identified by the numerals 24 and 26. The depending portions include extending parts that extend downwardly a greater distance as designated at 28 and 30. Overlying the extending portions 28 and 30 are stirrup straps as designated at 32 on the right hand side as shown in FIG. 4 and at 32' on the left hand side as may be seen in FIG. 2. The end of the strap 32 is attached to the portion 28 and at its other end is a buckle 36 which provides for adjustment in the length of the stirrup strap. The buckle 36 is provided in the strap, the buckle including a fitting with a loop 38 between the fitting and the stirrup member or fixture 40. The stirrup or stirrup fixture is made of metal conformed into a shape as shown to receive the foot of the child.

The upper end of the stirrup member 40 is formed into a loop as shown at 41 and then the loop 38 passes through this loop. The stirrup strap and adjustment and the stirrup itself are the same on both sides of the saddle, these items on the left side being identified by the same numerals primed.

Numeral 44 designates a strap, the upper end of which is attached to part 24 of the saddle and which has a metal buckle 46 at its end. On the other side of the saddle, as shown in FIG. 2, is a strap 48 attached at its upper end to part 26 of the saddle and this strap is securable to the buckle 46 when the straps are wrapped around the torso of the adult person, as shown in FIG. 1, the straps being secured by the buckle.

The underside of the saddle is of particular and unique construction, contour and configuration as is best seen in FIGS. 2, 3, 4 and 5. Numerals 50 and 52 designate what may be called the side wings of the lower part of the saddle. The area between these portions of the saddle fits over the adult person and this area is essentially flat, as designated at 60. Fitting into this area between the wings 50 and 52 are pieces of padding 62 and 64 which preferably may be plastic foam material. Numeral 70 designates another layer of padding which may be of the same material which is of greater lateral extent and which extends under the side parts 50 and 52 of the saddle. Padding 70 comes into contact with the intermediate portion or top of the person's back, and this portion of the padding is contoured so as to come down over the sides of the adult person's torso as may be seen in the figures so that the person is comfortable with the saddle mounted and secured by the straps.

Numeral 72 designates fabric material forming a saddle blanket which is preferably adhered to the underside of padding 70 and extends, as may be seen in FIGS. 2, 3 and 4. Another layer of thinner fabric 74 is adhered to the underside of blanket 72. Numeral 76 designates a strip of the same fabric material which covers the back part of the padding pieces 62 and 64.

FIG. 1 illustrates the utilization of the saddle, this FIGURE showing it strapped onto the back of a person in a posture on his hands and knees. This FIGURE shows the outlines of a child sitting in the saddle on area 20 with the child's feet in the stirrups 40 and 40'. It is to be observed that in the utilization of the saddle the child is comfortable and is in a safe position, since the child has his or her feet in the stirrups and can hold on to the saddle horn extending upward from the pommel. The adult person is also comfortable because of the interior configuration and contour of the saddle and the particular construction and arrangement of the padding so that the adult person is comfortable even with the added weight of the child in the saddle.

The foregoing disclosure is representative of a preferred form of the invention and is to interpreted in an illustrative, rather than a limiting sense, the invention to be accorded the fullest scope of the claims appended hereto.

What is claimed is:

1. As an article of manufacture, a miniaturized toy saddle having a size and a contour to be mounted on the back of an adult person and to carry a young child in the saddle, comprising in combination means contoured to provide a seat on the saddle for a young child to be seated astride the saddle, the underside of the seat part of the saddle being formed and contoured to include a flat part adapted to rest on the back of an adult person, the flattened portion of the underside of the saddle having a lateral extent sufficient to accommodate the back of a person in a hands and knees position and having contoured side parts to conform to the back of an adult person, strap means for attaching the saddle to the torso of an adult person, and adjustably attached stirrups carried by the saddle to accommodate the child's feet said saddle being formed of plastic having flexible depending side wing portions depending from the sides, and foam plastic padding material disposed horizontally underneath the seat part of the saddle, said padding material being separate from and substantially underlying only said seat part, the said plastic foam padding material being contoured to provide a generally flat padded part to fit against the back of the adult person.

2. An article as in claim 1 including plastic foam padded portions positioned to accommodate to sides of the adult person, said second mentioned plastic foam padded portions being underneath the said first mentioned padding material and having a greater lateral extent to extend partly along the sides of the adult person's torso but underneath portions of the saddle.

3. A saddle as in claim 2 including a section of fabric material constituting a saddle blanket positioned underneath and secured to the second mentioned plastic foam padded portions so that when the saddle is in position on the back of an adult person, the said fabric material contacts the person's back.

4. An article as in claim 1 wherein the saddle has in integral plastic part forming a saddle horn at the forward part of the saddle.

* * * * *